US008210864B1

(12) United States Patent
Hernandez et al.

(10) Patent No.: US 8,210,864 B1
(45) Date of Patent: Jul. 3, 2012

(54) CONNECTOR TERMINAL POSITION ASSURANCE DEVICE

(75) Inventors: Marcelino Hernandez, Coahuila (MX); Pedro Yabur, Coahuila (MX)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 13/072,146

(22) Filed: Mar. 25, 2011

(51) Int. Cl.
*H01R 13/62* (2006.01)

(52) U.S. Cl. ..... 439/352

(58) Field of Classification Search ..... 439/352, 439/607.23, 357–358, 488–489, 353
See application file for complete search history.

(56) References Cited

U.S. PATENT DOCUMENTS 6,383,011 B2 * 5/2002 Chen ..... 439/358
7,955,104 B1 * 6/2011 Wicks et al. ..... 439/188
2008/0050961 A1 * 2/2008 Johnson et al. ..... 439/352
2009/0163071 A1 * 6/2009 Chen ..... 439/352
2011/0021060 A1 * 1/2011 Urano et al. ..... 439/352

* cited by examiner

*Primary Examiner* — Jean F Duverne
(74) *Attorney, Agent, or Firm* — Paul W. Thiede

(57) ABSTRACT

A connector assembly is provided. The connector assembly includes a connector having a connector body, and Tab-Down terminal, and a terminal position assurance device (TPA). The connector body has a cavity located therein and a flexible arm that is elastically deformable. The Tab-Down terminal is slidable in a first direction and in a second direction that generally opposes the first direction. The Tab-Down terminal is insertable within the cavity of the connector body in the first direction. The terminal position assurance (TPA) device is slidably engageable within the cavity of the connector. The TPA device has a primary lock support that is selectively positioned adjacent the flexible arm to limit deformation of the flexible arm. The connector assembly includes a pre-stage position and a full-stage position. In the pre-stage position the Tab-Down terminal moveable within the cavity. In the full-stage position movement of the Tab-Down terminal is limited.

20 Claims, 5 Drawing Sheets

CONNECTOR TERMINAL POSITION ASSURANCE DEVICE

BACKGROUND OF THE INVENTION

The present invention relates to a connector assembly and in particular to a connector assembly having a terminal position assurance (TPA) device for restricting movement of a Tab-Down terminal.

Electrical connectors are provided with various devices for locking and retaining the terminals of a connector within the connector housing. Some types of terminals that are currently available are a Tab-Up type terminal and a Tab-Down type terminal. Each include a tab that is positioned along the body of the terminal. The specific location of the tab on the body of the terminal determines if the terminal is either a Tab-Up or a Tab-Down terminal.

One type of female connector currently available employs the Tab-Up type terminal. The cavity of the connector has a flexible arm that engages with and holds the Tab-Up terminal in place. A terminal position assurance (TPA) device is also provided in an effort to retain the Tab-Up terminal in place within the cavity of the connector. The TPA device includes a primary lock support and a secondary lock support. The primary lock support holds the Tab-Up terminal in place, and the secondary lock slides underneath the flexible arm. The secondary arm reduces or prevents the flexible arm from releasing the Tab-Up terminal once the secondary arm is locked.

One drawback to this configuration is that the current TPA device is unable to support the flexible arm in the event the flexible arm breaks or fails. Thus, if the flexible arm breaks the Tab-Up terminal can be inadvertently pulled out from the connector. Another drawback to the current configuration is that the cavity of the female connector and the TPA device are configured to receive the Tab-Up type terminal only.

SUMMARY OF THE INVENTION

A connector that receives a Tab-Down type terminal is provided. The connector retains the Tab-Down terminal in place within the cavity, even in the event that the cavity is damaged. A connector assembly is provided having a connector, a Tab-Down terminal and a TPA device. The connector has a connector body. The connector body has a cavity located therein and a flexible arm that is elastically deformable. The Tab-Down terminal is slidable in a first direction and in a second direction that generally opposes the first direction within the cavity. The Tab-Down terminal is insertable within the cavity of the connector body in the first direction. The TPA device is slidably engageable within the cavity of the connector. The TPA device has a primary lock support that is selectively positioned adjacent the flexible arm to limit deformation of the flexible arm. The connector assembly also includes a pre-stage position and a full-stage position, where the full-stage position is different from the pre-stage position. In the pre-stage position the flexible arm is deformable, and the Tab-Down terminal is moveable within the cavity in the second direction. In the full-stage position the primary lock support is positioned adjacent the flexible arm to limit deformation of the flexible arm. The flexible arm is engaged with the Tab-down terminal to limit movement of the Tab-Down terminal in the cavity in the second direction.

A method of assembling a connector assembly is also provided. A connector, a Tab-Down terminal, and a TPA device are provided. The connector has a connector body. The connector body has a cavity located therein and a flexible arm that is selectively deformable. The Tab-Down terminal is slidable in a first direction and in a second direction that generally opposes the first direction within the cavity. The TPA device is slidingly engaged into the cavity of the connector body and into a pre-stage position. The TPA device has a primary lock support that is selectively positioned adjacent the flexible arm to limit deformation of the flexible arm. The flexible arm is deformable and the Tab-Down terminal is moveable within the cavity in the second direction when the TPA device is in the pre-stage position. The Tab-Down terminal is inserted into the cavity of the connector in the first direction. The TPA device is slidable into a full-stage position that is different from the pre-stage position. In the full-stage position, the primary lock is positioned adjacent the flexible arm to limit deformation of the flexible arm. The flexible arm is also engaged with the Tab-Down terminal to limit movement of the Tab-Down terminal in the cavity in the second direction.

These and other advantages and features will become more apparent from the following description taken in conjunction with the drawings.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION

Figure 1:
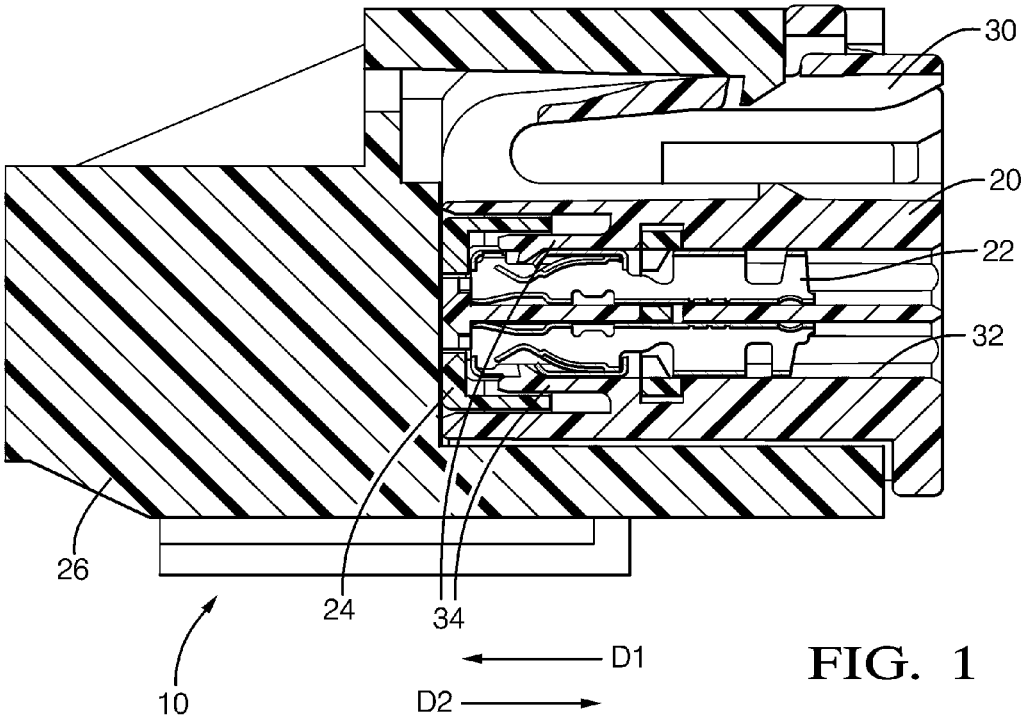
FIG. 1 is a cross-sectioned view of a connector assembly in accordance with one aspect of the invention.

Referring now to the Figures, where the invention will be described with reference to specific embodiments, without limiting same, FIG. 1 illustrates a connector assembly 10 in accordance with one aspect of the invention. In the exemplary embodiment shown, the connector assembly 10 is an electrical connector assembly for carrying electrical, fiber optic, or other types of conductors. It will be appreciated that like elements are described with like numerals throughout this disclosure. Where alternative embodiments of like elements are shown, a prefix numeral may be added to distinguish the element from alternative embodiments.

The connector assembly 10 includes a connector 20, a Tab-Down terminal 22, and a Terminal Position Assurance (TPA) device 24. As shown in the non-limiting embodiment of FIG. 1, the first connector 20 is a female type of connector that receives a male connector 26. The connector 20 includes a connector body 30, a cavity 32 located within the connector body 30, and at least one flexible arm 34. The Tab-Down terminal 22 is selectively slidable within the cavity 32 in a first direction D1 and a second direction D2. The second direction D2 is generally parallel with and generally opposes the first direction D1. As shown in FIG. 1, the connector assembly 10 is in a full-stage position where movement of the Tab-Down terminal 22 in the first and second directions D1 and D2 is limited or restricted by the TPA device 24.

Figure 2:
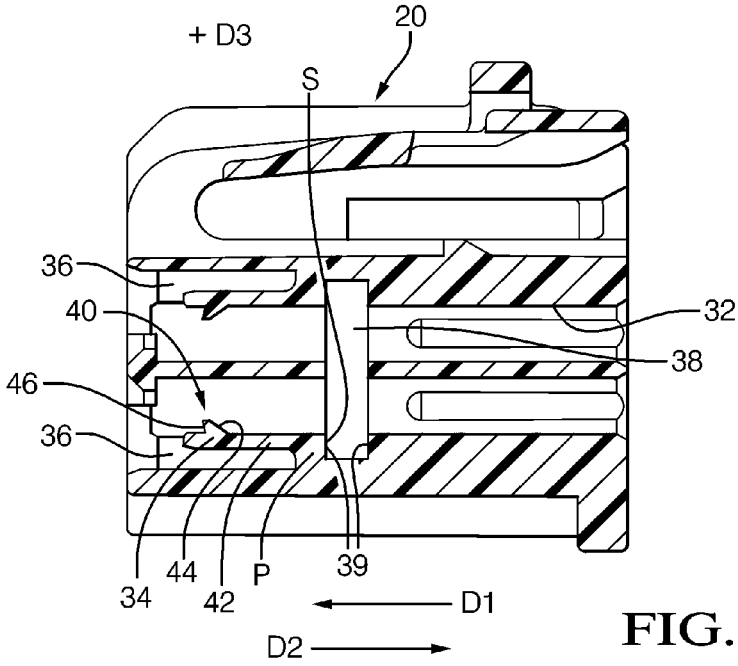
FIG. 2 is a cross-sectional view of the connector of FIG. 1.
Figure 5A:
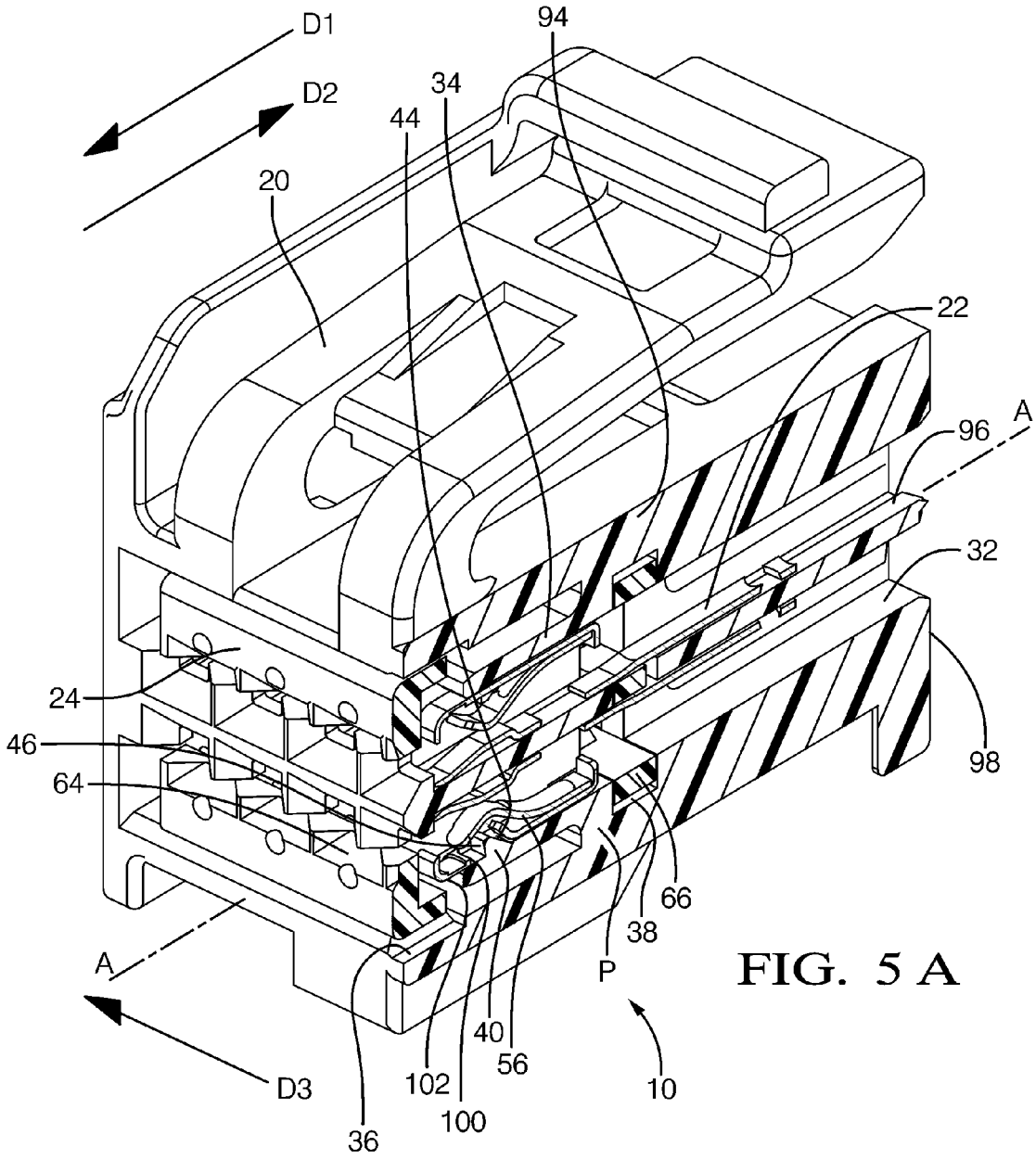
FIG. 5A is a perspective view, partially in cross-section of the connector assembly in a pre-stage position.
Figure 6A:
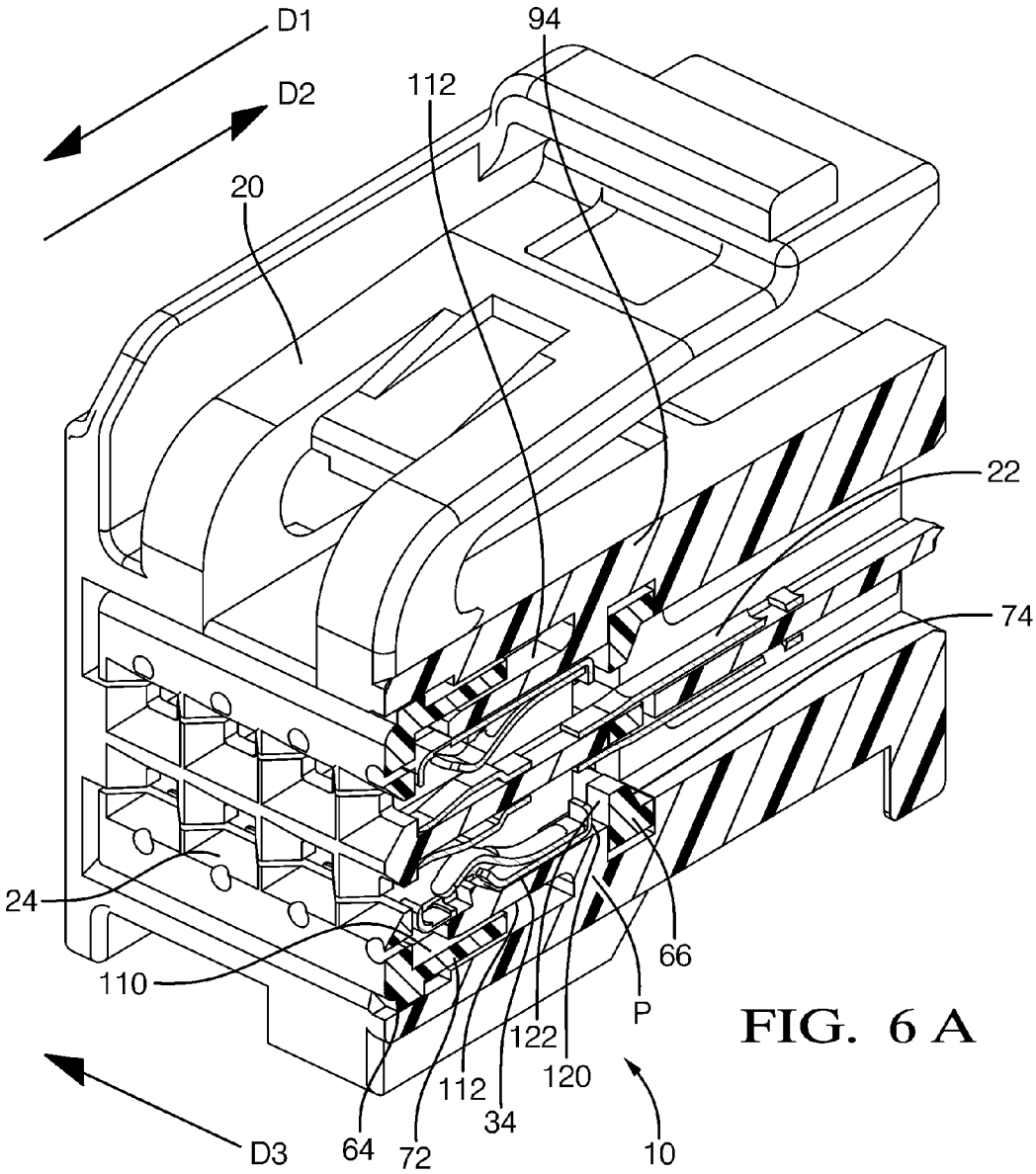
FIG. 6A is a perspective view, partially in cross-section of the connector assembly in a full-stage position.

FIG. 2 is a cross-sectioned view of the connector 20. The connector 20 includes a first TPA slot 36 and a second TPA slot 38 that are positioned within the cavity 32. The second TPA slot 38 and the flexible arm 34 each share a surface S, where the surface S represents a back side of the flexible arm 34 as well as one of the side surfaces 39 of the second TPA slot 38. The first TPA slot 36 and the second TPA slot 38 are oriented in a third direction D3 that is generally perpendicular to the first and second directions D1 and D2 (the third direction D3 is also shown in FIGS. 5A and 6A). The TPA device 24 (FIG. 1) is slid in the third direction D3 and into the first and second TPA slots 36 and 38 during assembly of the connector assembly 10. The flexible arm 34 is located within the cavity 32, and is elastically deformable about a pivot portion P. The flexible arm 34 includes a mating feature 40 that projects outwardly from an outer surface 42 of the flexible arm 34. The mating feature 40 is used to engage with the Tab-Down connector 22 (FIG. 1). The mating feature 40 includes a ramped surface 44 and an engagement surface 46. In the non-limiting embodiment as shown, the mating feature 40 is a snap-fit tab, however it is understood that other features may be used as well such as, for example, a finger that projects outwardly from the outer surface 42 of the flexible arm 34.

Figure 3:
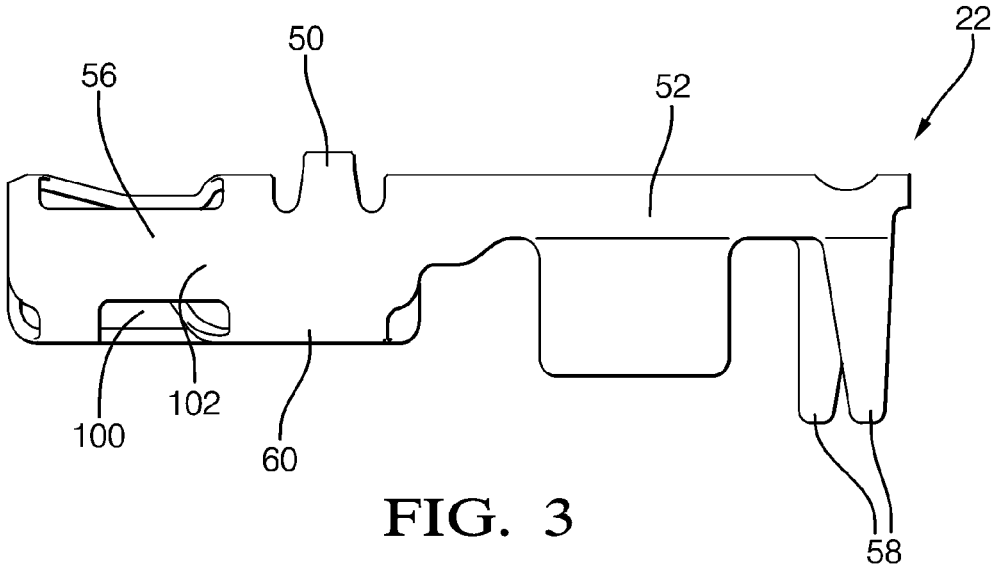
FIG. 3 is a side view of another aspect of the invention.

FIG. 3 is an illustration of the Tab-Down terminal 22. The Tab-Down terminal 22 is one type of electrical terminal where a tab 50 is located on the body 52 of the Tab-Down terminal 22. The Tab-down terminal 22 includes a box portion 56, crimp wings 58, and an insulation and crimp wing base 60. The tab 50 is located adjacent to the box portion 56 of the Tab-Down terminal 22, and on the same side of the Tab-Down connector 22 as the insulation and crimp wing base 60. The specific location of the tab 22 on the body 52 of the terminal will determine if a terminal is a Tab-Down terminal or a Tab-Up terminal.

Figure 4:
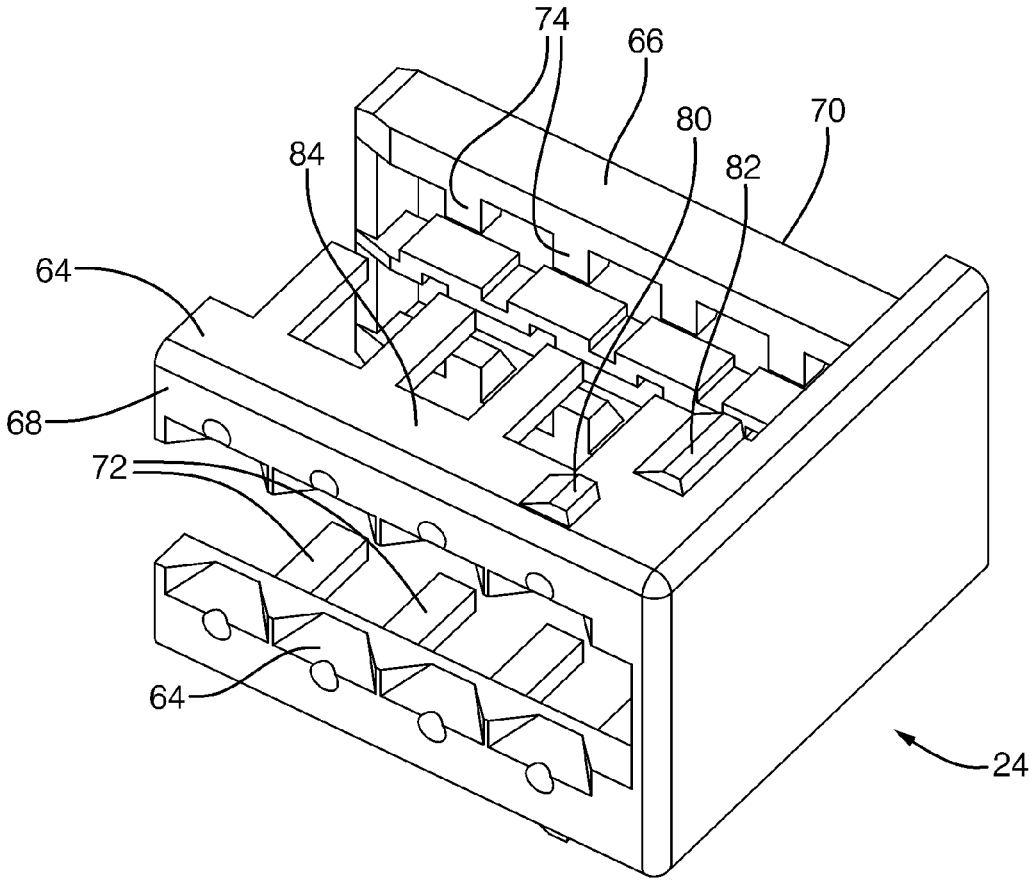
FIG. 4 is a perspective view of yet another aspect of the invention.

FIG. 4 is a perspective view of the TPA device 24. The TPA device 24 includes at least one primary lock support portion 64, at least one secondary lock support portion 66, a front portion 68, and rear portion 70. The primary lock support portion 64 includes a plurality of elongated members 72 that project from the front portion 68 of the TPA device 24 towards the rear portion 70. The secondary lock support portion 66 includes plurality of mechanical stops 74 that are raised protuberances that each project from the secondary lock support 66. The TPA device 24 also includes two positioning risers 80 and 82 located along a top surface 84 of the TPA device 24. In the non-limiting embodiment as shown, the positioning risers 80 and 82 are protuberances or tabs that project outwardly from the top surface 84 of the TPA device 24. The first positioning riser 80 abuts against a portion the body 94 of the connector 20 and positions the TPA device 24 in a pre-stage position shown in FIG. 5A (abutment between the first positioning riser 80 and the body 94 of the connector 20 not shown in FIG. 5A). The second positioning riser 82 abuts against with the body 94 of the connector 20 and positions the TPA device 24 in the full-stage position within the connector 20 shown in FIG. 6A (abutment between the second positioning riser 82 and the body 94 of the connector 20 not shown in FIG. 6A).

FIG. 5A is an illustration of the Tab-Down terminal 22 situated within the connector 20 where the TPA device 24 is positioned in the pre-stage position. Specifically, in one non-limiting embodiment, the connector 20 and the TPA device 24 are first assembled together in the pre-stage position in a first operation. The Tab-Down terminal 22 is then inserted into the cavity 32 in another subsequent operation. The TPA device 24 is inserted into the connector 20 in the third direction D3, where the first TPA slot 36 receives the primary lock support 64 of the TPA device 24, and the second TPA slot 38 receives the secondary lock portion 66 of the TPA device 24. Specifically, the TPA device 24 is slid in the third direction D3 until the first positioning riser 80 (shown in FIG. 4) abuts against a portion of the body 94 of the connector 20 (abutment not shown in FIG. 5A). Abutment of the first positioning riser 80 with the body 94 of the connector 20 positions the TPA device 24 in the pre-stage position.

After the TPA device 24 is positioned in the pre-stage position, the Tab-Down terminal 22 enters the connector 20 through an entrance or opening 96 located on a rear face 98 of the connector 20. The Tab-Down terminal 22 is slid in the first direction D1 within the cavity 32. The Tab-Down terminal 22 then engages with the mating feature 40 located on the flexible arm 34. Specifically, the box portion 56 of the Tab-down terminal 22 includes an opening 100 defined by a wall 102 (also shown in FIG. 3). As the Tab-Down terminal 22 is slid in the first direction D1, the wall 100 is squeezed inwardly towards an axis A-A of the connector 20 by the ramped surface 44 of the mating feature 40 (FIG. 2). The wall 102 of the box portion 56 then engages with the engagement surface 46 of the mating feature 40, and the opening 100 is positioned over the mating feature 40. Engagement of the mating feature 40 with the box portion 56 of the Tab-Down terminal 22 positions the Tab-Down terminal 22 in place within the cavity 32 of the connector 20.

When in the pre-stage position, movement of the Tab-Down terminal 22 in the second direction D2 is not limited or restricted. That is, if a force is exerted in the second direction D2 on the Tab-Down terminal 22, the Tab-Down terminal 22 can be pulled out of the cavity 32. This is because the flexible arm 34 located within the connector 20 can deform about the pivot portion P. The deformation of the flexible arm 34 can cause the mating feature 40 to disengage with the opening 100 of the Tab-Down terminal 22.

Figure 5B:
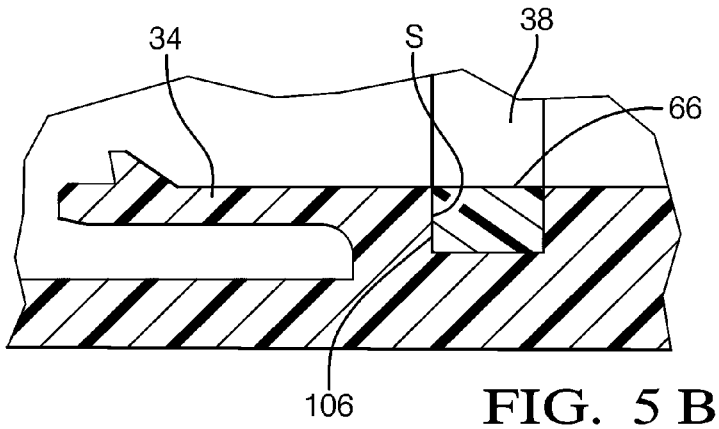
FIG. 5B is an enlarged view of a portion of FIG. 5A.

Referring to FIG. 5B, the secondary lock support portion 66 includes an engagement surface 106 that generally opposes the surface S that is shared between the second TPA slot 38 and the flexible arm 34 (also shown in FIG. 2). In the non-limiting embodiment as shown, the engagement surface 106 is generally parallel with the surface S, and the engagement surface 106 abuts against the surface S. The engagement surface 106 and the surface S are positioned to be generally perpendicular to the first and second directions D1 and D2 of the Tab-Down terminal 22.

In the non-limiting embodiment as shown, the connector assembly 10 includes a double-row configuration. That is, the TPA device 24 includes two primary lock support portions 64 as well as two secondary lock support portions 66, and the cavity 32 of the connector 20 has two flexible arms 34 that are located on opposing sides of the cavity 32. However it is understood that the connector assembly 10 may include other configurations as well. For example, the TPA device 24 may include only one primary lock support portion 64 as well as one secondary lock support portion 66, and the cavity 32 of the connector 20 may include only one flexible arm 34.

The Tab-Down terminal 22 is slid in the third direction D3 from the pre-stage position shown in FIG. 5A and into the full stage position as shown in FIG. 6A. In the full-stage position, the TPA device 24 locks the Tab-Down terminal 22 in place within the connector 20, where movement of the Tab-Down terminal 22 is restricted in the first and second directions D1 and D2. Specifically, the TPA device 24 is slid in the third direction D3 until the second positioning riser 82 (shown in FIG. 4) abuts against a portion of the body 94 of the connector 20. Abutment of the second positioning riser 82 with the body 94 of the connector 20 positions the TPA device 24 in the full-stage position (abutment not shown in FIG. 6A).

In the full stage position, one of the elongated members 72 of the primary lock support portion 64 align with the flexible arm 34 of the connector 20. Specifically, the primary lock support portion 64 includes a support surface 110 that generally opposes a bottom surface 112 of the flexible arm 34. The support surface 110 of the primary lock support portion 64 provides support to the flexible arm 34, and limits or prevents deformation of the flexible arm 34 about the pivot portion P. Specifically, the elongated member 72 of the primary lock support portion 64 is positioned adjacent and below the flexible arm 34 such that the support surface 110 contacts the bottom surface 112 of the flexible arm 34 if the flexible arm 34 slightly deforms, thereby limiting or preventing deformation of the flexible arm 34. Thus, when the TPA device 24 is in the full-stage position the Tab-Down terminal 22 is limited or restricted in movement in the second direction D2. This is because the flexible arm 34 located within the connector 20 is limited in movement about the pivot portion P. Therefore, the mating feature 40 located on the flexible arm 34 generally remains engaged with the opening 100 of the Tab-Down terminal 22.

In the full stage position, one of the plurality of mechanical stops 74 of the secondary lock support 66 aligns with a portion of the outer surface 120 of the Tab-Down connector 22. Specifically, the mechanical stop 74 includes a stopper surface 122 that is positioned parallel with the outer surface 120 of the Tab-Down connector 22. Therefore, if the Tab-Down connector 22 is pulled in the direction D2 by an external force, the stopper surface 122 of the mechanical stop 74 engages with the outer surface 120 of the Tab-Down connector 22, thereby reducing or preventing the Tab-Down terminal from being pulled out of the cavity 32. The mechanical stop 74 is also positioned in relation to the Tab-Down connector 22 to also provide minimum contact distances between the Tab-Down terminal 22 and a male blade (not shown) of the male connector 26 (FIG. 1) that is configured to mate with the Tab-Down terminal 22.

Figure 6B:
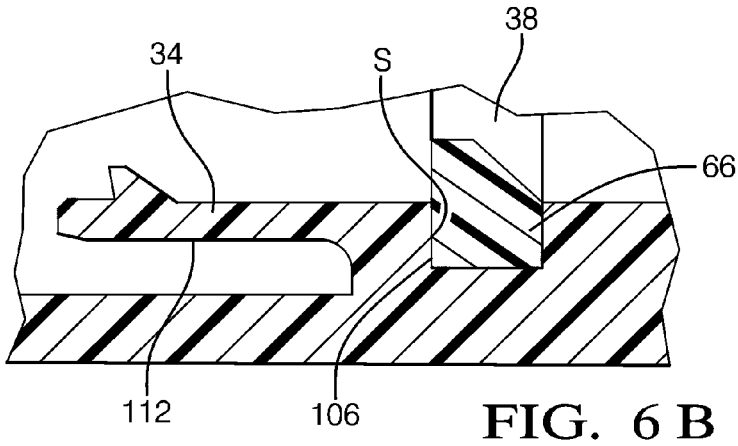
FIG. 6B is an enlarged view of a portion of FIG. 6A.

Referring to FIG. 6B, the engagement surface 106 and the surface S are oriented in relation to one another such that in the event the flexible arm 34 breaks off or fails, the engagement surface 106 of the secondary lock portion 66 holds the flexible arm 34 in place. The engagement surface 106 acts as a stopper to hold the flexible arm 34 in place. Therefore, if the flexible arm 34 fails, the Tab-Down terminal 22 may still be retained within the cavity 32, even if the Tab-Down terminal is pulled in the second direction D2 in an attempt to remove the Tab-Down terminal 22 from the cavity 32.

Figure 7:
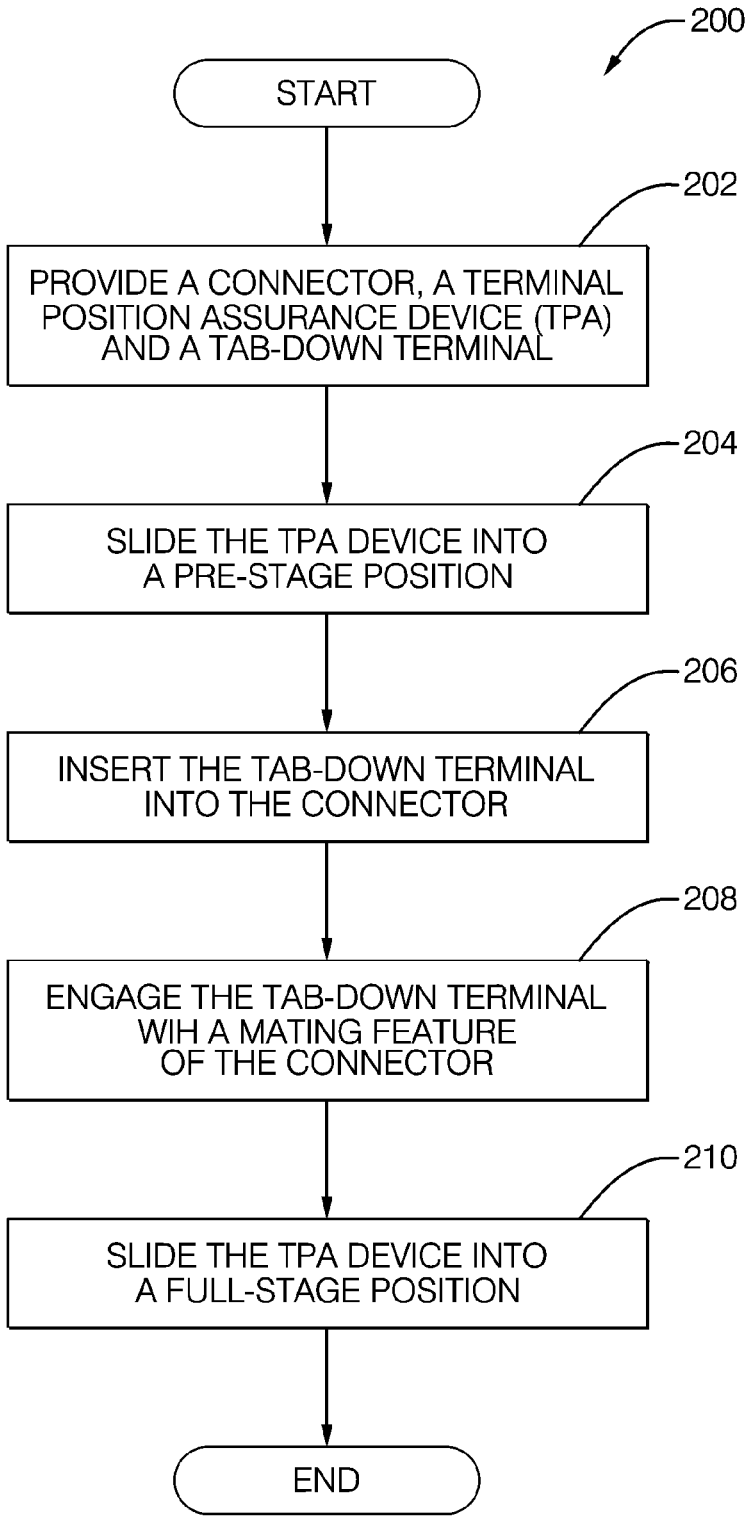
FIG. 7 is a flow diagram illustrating assembly of the connector assembly, in accordance with still yet another aspect of the invention.

A method of assembling the connector assembly 10 will now be explained. Referring to FIG. 7, an exemplary process flow diagram illustrating an exemplary process of assembling the connector assembly 10 is generally indicated by reference number 200. Process 200 begins at step 202, where a connector 20, a Tab-Down terminal 22, and a TPA device 24 are provided. Referring generally to FIGS. 1-2, the connector 20 includes a connector body 30, a cavity 32 located within the connector body 30, and a flexible arm 34. The Tab-Down terminal 22 is selectively slidable within the cavity 32 in a first direction D1 and a second direction D2. The second direction D2 is parallel with and generally opposes the first direction D1. The flexible arm 34 is located within the cavity 32, and is elastically deformable about a pivot portion P. Method 200 may then proceed to step 204.

In step 204, the TPA device 24 is slidingly engaged into the cavity 32 of the connector 20 in a third direction D3, and into a pre-stage position. Referring to FIGS. 1-2, a first TPA slot 36 and a second TPA slot 38 are oriented in the third direction D3 that is generally perpendicular to the first and second directions D1 and D2. The TPA device 24 (FIG. 1) is slid in the third direction D3 and into the first and second TPA slots 36 and 38 during assembly of the connector assembly 10. Referring to FIG. 4, the TPA device 24 includes at least one primary lock support portion 64, at least one secondary lock support portion 66, a front portion 68, and rear portion 70. The primary lock support portion 64 includes a plurality of elongated members 72 that project from the rear portion 68 of the TPA device 24. The secondary lock support portion 66 includes plurality of mechanical stops 74 that are raised protuberances that each project from the secondary lock support 66. The TPA device 24 is slid in the third direction D3 until a first positioning riser 80 (FIG. 4) engages a body 94 of the connector 20. Engagement of the first positioning riser 80 with the body 94 of the connector 20 positions the TPA device 24 in the pre-stage position. Method 200 may then proceed to step 206.

In step 206, the Tab-Down terminal 22 is inserted into the cavity 32 of the connector 20 in the first direction D1. Referring to FIG. 5, the Tab-Down terminal 22 is slid in the first direction D1 within the cavity 32 of the connector 20. In the non-limiting embodiment as shown, the TPA device 24 is first slid into the connector 20 and into the pre-stage position. Then, in another subsequent operation, the Tab-Down terminal 22 is slid in the first direction D1 and into the cavity 32 of the connector 20. Method 200 may then proceed to step 208.

In step 208, the Tab-Down terminal 22 engages with a mating feature 40 located on the flexible arm 34. Referring to FIG. 5A, a box portion 56 of the Tab-down terminal 22 includes an opening 100 and a wall 102. As the Tab-Down terminal 22 is slid in the first direction D1, the wall 100 is squeezed inwardly towards an axis A-A of the connector 20 by a ramped surface 44 of the mating feature 40. The wall 102 of the box portion 56 then engages with an engagement surface 46 of the mating feature 40, and the opening 100 is positioned over the mating feature 40. Engagement of the mating feature 40 with the box portion 56 of the Tab-Down terminal 22 positions the Tab-Down terminal 22 in place within the cavity 32 of the connector 20. Method 200 may then proceed to step 210.

In step 210, the TPA device 24 is slid into a full-stage position. In the full-stage position movement of the Tab-Down terminal 22 is limited in the second direction D2. Specifically, referring to FIG. 6A, the TPA device 24 locks the Tab-Down terminal 24 in place within the connector 22, where movement of the Tab-Down terminal 24 is restricted in the first and second directions D1 and D2. Specifically, the TPA device 24 is slid in the third direction D3 until a second positioning riser 82 (FIG. 4) engages the body 94 of the connector 20. Engagement of the second positioning riser 82 with the body 94 of the connector 20 positions the TPA device 24 in the full-stage position. In the full stage position, one of the elongated members 72 of the primary lock support portion 64 align with the flexible arm 34 of the connector 20. Specifically, the primary lock support portion 64 includes a support surface 110 that generally opposes a bottom surface 112 of the flexible arm 34. The support surface 110 of the primary lock support portion 64 provides support to the flexible arm 34, and limits or prevents deformation of the flexible arm 34 about the pivot portion P. Method 200 may then terminate.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description.

Having thus described the invention, it is claimed:

1. A connector assembly, comprising:

a connector having a connector body, the connector body having a cavity located therein and a flexible arm that is elastically deformable;

a Tab-Down terminal that is slidable in a first direction and in a second direction that generally opposes the first direction within the cavity, the Tab-Down terminal insertable within the cavity of the connector in the first direction; and a terminal position assurance (TPA) device slidably engageable within the cavity of the connector body, the TPA device having a primary lock support that is selectively positioned adjacent the flexible arm to limit deformation of the flexible arm, the flexible arm being deformable, the Tab-Down terminal moveable within the cavity in the second direction in a pre-stage position, and the primary lock support positioned adjacent the flexible arm to limit deformation of the flexible arm, and the flexible arm engaged with the Tab-down terminal to limit movement of the Tab-Down terminal in the cavity in the second direction in a full-stage position that is different from the pre-stage position.

2. The connector assembly of claim 1, including a secondary lock portion with the TPA device, the secondary lock portion having a second engagement surface that generally opposes a first engagement surface of the flexible arm, the first engagement surface and the second engagement surface being generally perpendicular to the first and second directions.

3. The connector assembly of claim 2, wherein the second engagement surface abuts against the first engagement surface in the pre-stage and full-stage positions.

4. The connector assembly of claim 2, including a mechanical support of the TPA device, wherein the mechanical support is a raised protuberance that projects from the secondary lock support.

5. The connector assembly of claim 4, including a mechanical support surface located on the mechanical support, the mechanical support surface generally opposing an outer surface of the Tab-Down connector in the full-stage position.

6. The connector assembly of claim 5, wherein the mechanical support surface abuts the outer surface of the Tab-Down connector, and abutment of the mechanical support surface with the outer surface of the Tab-Down connector limits movement of the Tab-Down connector in the second direction in the full-stage position.

7. The connector assembly of claim 1, wherein the TPA device is engageable within the cavity of the connector in a third direction that is generally perpendicular to the first direction and the second direction.

8. The connector assembly of claim 1, wherein the primary lock support is an elongated member that projects from the TPA device in the second direction.

9. The connector assembly of claim 8, wherein the primary lock support has a top surface, and wherein the flexible arm has a support surface that generally opposes the top surface of the primary lock support in the full-stage position.

10. The connector assembly of claim 9, wherein the top surface of the primary lock support limits deformation of the flexible arm in the full-stage position.

11. The connector assembly of claim 1, wherein the flexible arm includes a mating feature that projects from the flexible arm, and wherein the mating feature engages with the Tab-Down terminal to position the Tab-down terminal within the cavity of the connector.

12. The connector assembly of claim 1, wherein the connector is a female connector that is configured to receive a male connector.

13. A method of assembling a connector assembly, comprising:

providing a connector, a Tab-Down terminal, and a TPA device, the connector having a connector body, the connector body having a cavity located therein and a flexible arm that is elastically deformable, and the Tab-Down terminal slidable in a first direction and in a second direction that generally opposes the first direction within the cavity;

slidingly engaging the TPA device into the cavity of the connector body and into a pre-stage position, the TPA device having a primary lock support that is selectively positioned adjacent the flexible arm to limit deformation of the flexible arm, the flexible arm deformable and the Tab-Down terminal moveable within the cavity in the second direction when the TPA device is in the pre-stage position;

inserting the Tab-Down terminal into the cavity of the connector in the first direction; and sliding the TPA device into a full-stage position that is different from the pre-stage position, the primary lock positioned adjacent the flexible arm to limit deformation of the flexible arm, and the flexible arm engaged with the Tab-Down terminal to limit movement of the Tab-Down terminal in the cavity in the second direction.

14. The method of claim 13, including providing a secondary lock portion with the TPA device, the secondary lock portion having a second engagement surface that generally opposes a first engagement surface of the flexible arm, the first engagement surface and the second engagement surface being generally perpendicular to the first and second directions.

15. The method of claim 14, including providing a mechanical support with the TPA device, wherein the mechanical support is a raised protuberance that projects from the secondary lock support.

16. The method of claim 15, including providing a mechanical support surface located on the mechanical support, the mechanical support surface generally opposing an outer surface of the Tab-Down connector in the full-stage position.

17. The method of claim 13, including slidingly engaging the TPA device within the cavity of the connector in a third direction, the third direction being generally perpendicular to the first direction and the second direction.

18. The method of claim 13, including engaging a mating feature with the Tab-Down connector to position the Tab-down terminal within the cavity of the connector, the mating feature projecting from the flexible arm.

19. A connector assembly, comprising:

a connector having a connector body, the connector body having a cavity located therein and a flexible arm, the flexible arm being elastically deformable and having a first engagement surface;

a Tab-Down terminal slidable in a first direction and in a second direction that generally opposes the first direction within the cavity, the Tab-Down terminal insertable within the cavity of the connector body in the first direction;

a terminal position assurance (TPA) device slidably engageable within the cavity of the connector body in a third direction that is generally perpendicular to the first direction and the second direction, the TPA device having a primary lock support and a secondary lock support, the primary lock support selectively positioned adjacent the flexible arm to limit deformation of the flexible arm, and the secondary lock portion having a second engagement surface that generally opposes the first engagement surface of the flexible arm, the first engagement surface and the second engagement surface being generally perpendicular to the first and second directions, the flexible arm being deformable, and the Tab-Down terminal moveable within the cavity in the second direction in a pre-stage position; and wherein the primary lock support is positioned adjacent the flexible arm to limit deformation of the flexible arm, and the flexible arm engaged with the Tab-down terminal to limit movement of the Tab-Down terminal in the cavity in the second direction in a full-stage position that is different from the pre-stage position, and the second engagement surface abutting against the first engagement surface in the pre-stage and full-stage positions.

20. The connector assembly of claim 19, wherein the primary lock support is an elongated member that projects from the TPA device in the second direction, wherein the primary lock support has a top surface and the flexible arm has a support surface that generally opposes the top surface of the primary lock support in the full-stage position.

* * * * *